United States Patent [19]

Benford et al.

[11] 4,115,160

[45] Sep. 19, 1978

[54] ELECTROMAGNETIC SILICON STEEL FROM THIN CASTINGS

[75] Inventors: James G. Benford; Harry L. Bishop, Jr., both of Pittsburgh, Pa.

[73] Assignee: Allegheny Ludlum Industries, Inc., Pittsburgh, Pa.

[21] Appl. No.: 807,092

[22] Filed: Jun. 16, 1977

[51] Int. Cl.[2] ..... H01F 1/04

[52] U.S. Cl. ..... 148/111; 148/112; 148/113; 148/2

[58] Field of Search ..... 148/110, 111, 112, 113, 148/31.55, 2; 75/123 L

[56] References Cited

U.S. PATENT DOCUMENTS

| | | | |
|---|---|---|---|
| 3,115,430 | 12/1963 | Jackson et al. | 148/2 |
| 3,876,476 | 4/1975 | Matsuoka et al. | 148/110 |
| 4,006,044 | 2/1977 | Oya et al. | 148/31.55 |
| 4,014,717 | 3/1977 | Barisoni et al. | 148/111 |
| 4,030,950 | 6/1977 | Shilling et al. | 148/112 |
| 4,032,366 | 6/1977 | Choby | 148/113 |

*Primary Examiner*—W. Stallard

*Attorney, Agent, or Firm*—Vincent G. Gioia; Robert F. Dropkin

[57] ABSTRACT

A process for producing electromagnetic silicon steel having a cube-on-edge orientation. The process includes the steps of: preparing a melt of silicon steel, casting a strip of said steel, hot rolling, cold rolling, decarburizing, and final texture annealing. The cast strip has a thickness of from 0.15 to 1.0 inch.

8 Claims, No Drawings

ELECTROMAGNETIC SILICON STEEL FROM THIN CASTINGS

The present invention relates to an improvement in the manufacture of grain-oriented silicon steel.

Through the present invention there is provided a process for producing electromagnetic silicon steel having a cube-on-edge orientation, from thin castings. A process which produces high quality electromagnetic silicon steel, despite the fact that the material undergoes considerably less rolling than in conventional processing.

By continuously casting thin strips, the subject invention should result in a substantial improvement in the hot-metal to wrought product yield of conventional processing; as well as in a more chemically and structurally uniform product, as contrasted to conventional processing and processing involving continuously cast slabs. Also attributable to the subject invention is a probable saving in capital equipment and energy costs.

A process for producing electromagnetic silicon steel from thin castings is disclosed in U.S. Pat. No. 3,115,430. Said process is dissimilar from that of the present invention in that it requires three distinct cold rolling stages, each separated by an intervening anneal. The present invention involves one, or possibly two cold rolling stages, with at most one intervening anneal.

Another process for producing electromagnetic silicon steel is disclosed in U.S. Pat. No. 3,061,486. The steel produced thereby does not have a cube-on-edge orientation. Rather, as the title indicates it is "Non-Directional Oriented Silicon-Iron".

Other patents disclose processes in which a slab of silicon iron is continuously cast. These patents include U.S. Pat. Nos. 3,841,924, 3,843,422, 4,006,044, and 4,014,717. None of them, however, disclose the subject invention wherein a thin strip of from 0.15 to 1.0 inch is cast. In fact, U.S. Pat. No. 3,841,924 specifies that the slab must be 150 mm (5.9 inches) thick.

It is accordingly an object of the present invention to provide an improvement in the manufacture of grain-oriented silicon steel.

In accordance with the present invention a melt of silicon steel containing, by weight, up to 0.07% carbon, from 0.015 to 0.24% manganese, from 0.01 to 0.09% of material from the group consisting of sulfur and selenium, up to 0.0080% boron, up to 0.05% aluminum, up to 0.0200% nitrogen, up to 1.0% copper and from 2.5 to 4.0% silicon is subjected to the conventional steps of casting, hot rolling, cold rolling to a final gage no greater than 0.020 inch, an intervening anneal when two cold rolling stages are employed, decarburizing, and final texture annealing; and to the improvement comprising the step of casting said steel as a thin strip having a thickness of from 0.15 to 1.0 inch. Specific processing, as to the conventional steps, is not critical and can be in accordance with that specified in any number of publications including U.S. Pat. Nos. 2,867,557, 3,855,020 and 4,000,015 and others from the group cited hereinabove. The term casting is intended to include continuous casting processes, the most practical means for casting the thin strip of the subject invention. A hot rolled band heat treatment is also includable within the processing described hereinabove. The steel is generally hot rolled to a thickness of from 0.050 to 0.120 inch. Cold rolling is carried out in no more than two stages; i.e. no more than two cold rolling passes are separated by an intervening anneal. As for the thin strip, it is generally less than 0.5 inch thick, and preferably from 0.2 to 0.45 inch.

Electromagnetic steel produced in accordance with the subject invention is characterized by a permeability of at least 1820 ($G/O_e$) at 10 oersteds. Particular embodiments are, however, characterized by permeabilities in excess of 1870 ($G/O_e$) at 10 oersteds. These embodiments contain, in the melt, at least one element from the group consisting of aluminum in an amount of from 0.015 to 0.05% and boron in an amount of from 0.0006 to 0.0080%. Boron-bearing embodiments generally have less than 0.008% aluminum, and more than 0.0008% boron.

The following examples are illustrative of several aspects of the invention.

EXAMPLE I

A sample of silicon steel was cast and processed into electromagnetic silicon steel having a cube-on-edge orientation. The steel was cast to a thickness of 0.25 inch. The as-cast chemistry was as follows:

| C | Mn | S | Si | Al | N | Fe |
|---|---|---|---|---|---|---|
| 0.052 | 0.12 | 0.042 | 3.25 | 0.035 | 0.0075 | Bal. |

Processing for the cast steel involved soaking at an elevated temperature for 15 minutes, hot rolling to a thickness of 0.095 inch, heat treating at a temperature of 2050° F. for 1 minute, cooling to 1200° F. and water quenching therefrom, cold rolling to a thickness of 0.0115 inch, decarburizing at a temperature of 1475° F., coating with a refractory oxide base coating, and final texture annealing at a maximum temperature of 2150° F. in hydrogen.

The resulting steel had highly desirable properties, despite the fact that it underwent considerably less hot rolling than in conventional processing and despite the fact that it did not receive three distinct cold rolling stages as required by U.S. Pat. No. 3,115,430 (discussed hereinabove). The steel had a permeability of 1901 ($G/O_e$) at 10 oersteds and a core loss of 0.68 watts per pound at 17 kilogauss - 60 Hz.

EXAMPLE II

Another sample of silicon steel was cast and processed into electromagnetic silicon steel having a cube-on-edge orientation. The steel was cast to a thickness of 0.025 inch. The as-cast chemistry was as follows:

| C | Mn | S | Si | Al | Cu | B | N | Fe |
|---|---|---|---|---|---|---|---|---|
| 0.026 | 0.043 | 0.018 | 3.21 | 0.004 | 0.34 | 0.0014 | 0.0060 | Bal. |

Processing for the cast steel involved soaking at an elevated temperature for 15 minutes, hot rolling to a thickness of 0.080 inch, heat treating at a temperature of 1650° F. for 2 minutes, cold rolling to a thickness of 0.060 inch, heat treating at 1740° F. (at temperature for about 1 minute), cold rolling to a thickness of 0.0115 inch, decarburizing at a temperature of 1475° F., coating with a refractory oxide coating, and final texture annealing at a maximum temperature of 2150° F. in hydrogen.

The resulting steel had highly desirable properties as did the steel of Example I. The steel had a permeability of 1895 ($G/O_e$) at 10 oersteds and a core loss of 0.705 watts per pound at 17 kilogauss - 60 Hz.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. In a process for producing electromagnetic silicon steel having a cube-on-edge orientation, which process includes the steps of: preparing a melt of silicon steel containing, by weight, up to 0.07% carbon, from 0.015 to 0.24% manganese, from 0.01 to 0.09% of material from the group consisting of sulfur and selenium, up to 0.0080% boron, up to 0.05% aluminum, up to 0.0200% nitrogen, up to 1.0% copper and from 2.5 to 4.0% silicon; casting said steel; hot rolling said steel; cold rolling said steel to a final gage no greater than 0.020 inch, said steel being cold rolled with no more than two cold rolling passes being separated by an intervening anneal; decarburizing said steel; and final texture annealing said steel; the improvement comprising the step of casting said steel as a strip having a thickness of from 0.15 to 1.0 inch.

2. A process according to claim 1, wherein the steel is cast as a strip having a maximum thickness of 0.5 inch.

3. A process according to claim 1, wherein the steel is cast as a strip having a thickness of from 0.2 to 0.45 inch.

4. A process according to claim 1, wherein the melt contains at least one element from the group consisting of aluminum in an amount of from 0.015 to 0.05% and boron in an a amount of from 0.0006 to 0.0080% and wherein said electromagnetic silicon steel has a permeability of at least 1870 ($G/O_e$) at 10 oersteds.

5. A process according to claim 4, wherein the melt has from 0.015 to 0.05% aluminum.

6. A process according to claim 4, wherein the melt has from 0.0006 to 0.0080% boron and no more than 0.008% aluminum.

7. A process according to claim 6, wherein the melt has at least 0.0008% boron.

8. A process according to claim 1, wherein said electromagnetic silicon steel has a permeability of at least 1820 ($G/O_e$) at 10 oersteds.

* * * * *